United States Patent [19]

Borbely et al.

[11] 3,983,018

[45] Sept. 28, 1976

[54] PURIFICATION OF NICKEL ELECTROLYTE BY ELECTROLYTIC OXIDATION

[75] Inventors: Gyula John Borbely, Copper Cliff; Alexander Illis, Mississauga; Bernardus Jacobus Brandt, Port Colborne, all of Canada

[73] Assignee: The International Nickel Company, Inc., New York, N.Y.

[22] Filed: Sept. 10, 1975

[21] Appl. No.: 612,011

[30] Foreign Application Priority Data

Feb. 12, 1975 Canada ..... 219948

[52] U.S. Cl. ..... 204/130; 204/113

[51] Int. Cl.[2] ..... C25F 7/02; C25D 21/16

[58] Field of Search ..... 204/130, 149, 140, 232, 204/112, 240, 113

[56] References Cited

UNITED STATES PATENTS

| | | | |
|---|---|---|---|
| 2,394,874 | 2/1946 | Renzoni | 204/113 |
| 3,334,034 | 8/1967 | Geldzahler | 204/130 |
| 3,457,152 | 7/1969 | Maloney, Jr. et al. | 204/130 |
| 3,640,805 | 2/1972 | Knight | 204/130 |

FOREIGN PATENTS OR APPLICATIONS

| | | |
|---|---|---|
| S31-4904 | 6/1956 | Japan |
| 185,072 | 7/1966 | U.S.S.R. |

*Primary Examiner*—T. M. Tufariello

*Attorney, Agent, or Firm*—Walter A. Petersen; Ewan C. MacQueen; Raymond J. Kenny

[57] ABSTRACT

The presence of one or more of cobalt, iron, arsenic and lead is most substantially reduced in a nickel-containing electrolyte by an electrochemical process utilizing a high current density at the cathode in an electrolytic cell containing specific quantities of chlorides of alkali metals to form a fine nickel hydroxide precipitate. In a subsequent time dependent reaction under controlled pH conditions, nickel hydroxide reacts with the electrolyte to form insoluble precipitates of cobalt, iron, arsenic and lead which are removed from the electrolyte by filtration.

14 Claims, 1 Drawing Figure

PURIFICATION OF NICKEL ELECTROLYTE BY ELECTROLYTIC OXIDATION

Figure 1:
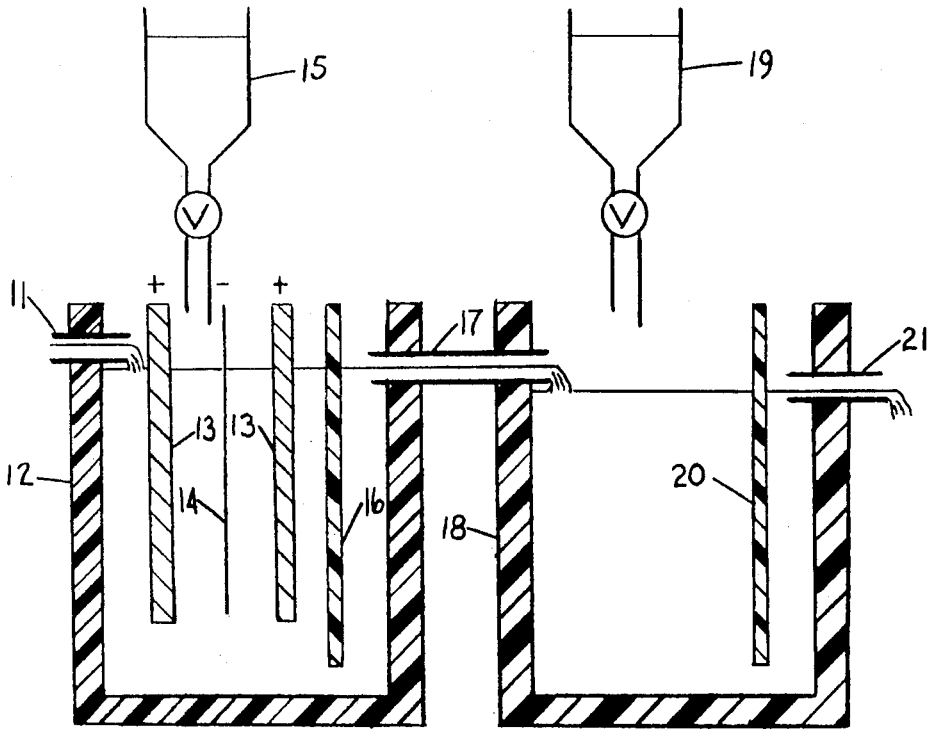

The present invention relates to the production of high purity nickel by electrorefining, and, more particularly, to an improved electrochemical process for markedly reducing the presence of cobalt, iron, arsenic and lead contaminants from the nickel-containing electrolyte.

During the electrorefining of nickel, it is usually necessary to purify the electrolyte by removing elements such as copper, cobalt, iron, arsenic and lead. In a currently used process described in Canadian Pat. No. 440,659, a high degree of electrolyte purification is accomplished, but this requires a number of complex stages to effect the removal of iron, copper and cobalt. The process of the present invention is deemed less costly, considered easier to carry forward and further differs in that electrochemical rather than chemical separation is used. Electrochemical techniques have been heretofore proposed. For example, in a prior art process, only cobalt was separated from nickel whereas in the present invention, iron, lead and arsenic are removed concurrent with the cobalt. The present invention eliminates the plating of metallic nickel at the cathode which presented a significant problem with the economic application of this prior art process. Further, the requirement for alkali additions necessary for control of pH is largely reduced through in situ generation of nickel hydroxide.

It has now been discovered that a nickel electrolyte used, for example, in the process of electrowinning nickel, can be purified prior to plating by an electrochemical means. The levels of the impurity elements cobalt, iron, arsenic and lead contained within the electrolyte can be reduced substantially. In the process of this invention, an impure nickel-containing electrolyte having low copper content and containing chloride salts of an alkali metal is introduced into an electrolytic tank containing one or more insoluble anodes and at least one cathode. The anode surface area is at least 20 times as great as the surface area of the cathode resulting in a high current density on the cathode surface. During electrolysis, nickel hydroxide and hydrogen form at the cathode. Elemental chlorine forms at the anode and immediately reacts with the electrolyte to form hydrochloric and hypochlorous acids. The latter serves as an oxidizer in a time-dependent reaction with cobalt.

Cobalt, iron, arsenic and lead precipitates begin to form in the electrolytic tank through preferential oxidation by the hypochlorous acid and precipitation is generally completed in a retention tank removed from the electrolytic tank. After a sufficient reaction period, the cobalt, iron, arsenic and lead precipitates are separated from the purified electrolyte by a conventional filtering operation.

It is an object of this invention to remove substantially at least one impurity from a group consisting of cobalt, iron, arsenic and lead from a nickel electrolyte.

It is a further object of this invention to reduce the quantity of raw materials and the amount of energy consumed in the purification of nickel electrolyte used in an electrorefining operation.

The foregoing objects and the means whereby they are attained will be more fully understood from the following description taken in conjunction with the accompanying drawing in which there is shown a sectional view of the electrolytic and retention tanks.

Generally speaking, the process of this invention is used to remove at least one impurity from a group consisting of cobalt, iron, arsenic and lead from an aqueous, essentially copper-free, nickel-containing electrolyte and comprises immersing at least one anode and at least one cathode into said electrolyte, said electrolyte containing a chloride salt of an alkali metal; applying a current between said anode and said cathode for a time period sufficient to generate in said electrolyte an equivalent chlorine content of at least about 0.05 gram per liter while maintaining the current density at said cathode at a level sufficient to prevent substantial deposition of metal at said cathode but sufficient to generate a metal hydroxide in the vicinity of said cathode; increasing the pH of said electrolyte whereby said equivalent chlorine produced reacts with at least one impurity present in said electrolyte to provide a precipitate containing said at least one impurity; and separating said precipitate from said electrolyte.

It is a requirement of the process that the surface area of the anode be at least about 20 times that of the cathode. Due to this high surface area ratio, high current densities, between about 6,000 and about 39,000 amps./m$^2$ are attained on the surface of the cathode. High current density is required to avoid plating of nickel and other metallic ions at the cathode. Below about 6,000 amps./m$^2$ metallic ions will plate, and above about 39,000 amps./m$^2$ metallic ions and hydrates will plate on the cathode. The current density at the anode is limited by geometric considerations and the ability to efficiently generate and react chlorine with the electrolyte. That is, with decreasing anode surface area, greater amounts of chlorine will bubble off rather than dissolve and also a greater tendency for breakdown of newly formed hypochlorous acid will exist.

Successful operation of the process is dependent upon the presence of chloride ions of an alkali metal, preferably sodium. It is necessary that the chloride ion concentration be greater than about 5 grams per liter and the alkali metal concentration be greater than about 2 grams per liter. Upper limits have not been established for these ions however, substantial quantities may be present. For example, in the case of an "all-chloride" bath, as much as about 150 gpl of chloride ion may be present.

The anode material used in this invention may be graphite, or a metallic, acid-resistant, conductive material. The cathode material may be a steel in rod or other suitable form. Other electrode materials and forms may also be used and include conductive substances having sufficient corrosion resistance in oxidizing alkaline and acid environments. The spacing of anode and cathode is not considered critical, however, they should be placed within reasonable proximity to allow efficient operation yet apart a sufficient distance to provide separation of the electro-chemical reactions and to avoid short circuiting.

Referring to FIG. 1, electrolyte which has passed through a copper removal process and containing very little copper enters the agitated electrolytic tank 12 through pipe 11 where it interacts with the anode 13 and the cathode 14. A first addition tank 15 can be used to adjust the hydrogen ion concentration or pH of the electrolyte. The reactions at the anode and cathode are dependent on the presence of chloride salts of alkali metals and a high current density at the cathode. It is advantageous to insert a baffle 16 between the oxidized electrolyte and the exit pipe 17 to reduce the through-put of non-oxidized electrolyte.

The oxidizer formed at the anode, hypochlorous acid, begins to react with divalent cobalt ions and similar ions of iron, arsenic and lead in the electrolytic tank. However, since the oxidation reaction is time dependent, the solution is generally transferred through exit pipe 17 to a retention tank 18 generally by gravity feed.

The majority of the cobaltous ion to cobaltic oxide reaction occurs within the agitated retention tank. A controlled quantity of a pH adjusting liquid is introduced to the retention tank from a second addition tank 19 to adjust the hydrogen ion concentration or pH of the electrolyte. The retention tank contains a baffle 20 which causes separation of the incoming electrolyte from that which has already reacted. The oxidized electrolyte leaves the retention tank through pipe 21 and is pumped or gravity-fed to a filter not shown. Cobalt, iron, arsenic and lead precipitates are removed from the liquid stream in the filtering operation. Purified electrolyte may be returned to the refining circuit at this point or alternatively sent through one or more additional processing sequences as aforedescribed for further reduction of impurity content.

The operating temperature of the electrolytic and retention tanks is generally maintained at the same temperature as that of the nickel electrorefining circuit. Temperatures in the range of about 50°C. to about 65°C. are used.

All-sulfate or all-chloride electrolytes and mixtures of these may be purified with the process of this invention. The compositions in grams per liter of typical nickel electrolytes treated by this process follow:

| | | | |
|---|---|---|---|
| $Ni^{++}$ | 40–80 | $H_3BO_3$ | 5–20 |
| $Co^{++}$ | .05–.5 | $As^{+++}$ | .001–.2 |
| $Na^{+}$ | 2–50 | $Pb^{++}$ | .0001–.01 |
| $Cl^{-}$ | 5–90 | $Cu^{++}$ | up to .01 |
| $SO_4^{=}$ | 2–150 | | |

The chemical reactions believed to occur during electrochemical oxidation of the electrolyte will be considered in order to demonstrate the operation of this invention. The discussion will center on cobalt; however, similar reactions are believed to occur with the iron, arsenic and lead ions present in the solution.

Under the influence of the applied current, sodium or other alkali metal ions are attracted to and arrive at the cathode before nickel and other metallic ions due to their higher mobility. Sodium ions pick up electrons from the cathode and immediately react with water present in the electrolyte to form sodium hydroxide and hydrogen gas, the latter escaping from the electrolytic tank. Nickel ions encounter the increased concentration of sodium hydroxide in the vicinity of the cathode and react to form a fine nickel hydroxide precipitate which serves to beneficially increase the pH of the electrolyte at this stage as well as later on in the process. It is generally considered beneficial to thoroughly agitate the electrolyte to break up the nickel hydroxide precipitate into a fine dispersion suited for neutralization of acid. The pH of the electrolyte upon entering the electrolytic tank is about 2.5 to 5.5 for a batch operation and from about 3.2 to 4.5 is preferred in a continuous operation.

Chloride ions give up electrons and form elemental chlorine at the anode. This chlorine immediately reacts with water contained in the electrolyte forming hypochlorous and hydrochloric acids. A summation of the reactions believed to occur during electrolysis follows:

$$2\ NaCl + NiSO_4 + H_2O + 4\ e \longrightarrow Ni(OH)_2 + 2\ HOCl + Na_2SO_4 + 2\ H_2 \uparrow$$

The oxidizing power of the electrolyte at this point in the process is governed by the current density at the anode, efficiency of chlorine reaction with the electrolyte, tank size, and the residence time in the electrolytic cell. Typically, a concentration equivalent to about 0.2 to 0.8 grams per liter of chlorine is attained in this process. The residence time in the electrolytic tank is generally between about 2 and 20 minutes and the pH is in the range 3.6 to 4.2.

Hypochlorous acid is the ingredient essential to the oxidation of unwanted metallic ions. Precipitation of hydrated cobaltic oxide or cobaltic hydroxide as well as oxidic forms of iron, arsenic and lead begins within the electrolytic cell by reaction with the hypochlorous acid; however, the rate of reaction is relatively slow. Because of this, the liquid containing hypochlorous acid is generally transferred to a retention tank where it is held for sufficient time, from about 20 minutes to about 2 hours and typically 40 minutes, for the oxidation reaction and hydrolyzation to occur. It has been found expedient to add a small amount of an alkaline solution such as sodium carbonate solution to the electrolyte in the retention tank to raise its pH to at least 4.5 to as much as, for example, 5.0 from the previous 3.6 to 4.2 level.

A summation of the reactions that start in the electrolytic tank and proceed further in the retention tank are given by the following equation:

$$2\ HOCl + Ni(OH)_2 + 4\ H_2O + 4\ CoSO_4 + 4\ Na_2CO_3 \longrightarrow NiCl_2 + 4\ Na_2SO_4 + 4CO_2 \uparrow + 4\ Co(OH)_3 \downarrow$$

In a continuous production operation, however, it is advantageous to add a slurry of nickel carbonate to avoid an unnecessary increase in the sodium ion concentration of the electrolyte. A summation of the reactions believed to occur with this procedure follows:

$$2\ HOCl + Ni(OH)_2 + 4\ H_2O + 4\ CoSO_4 + 4\ NiCO_3 \longrightarrow NiCl_2 + 4\ NiSO_4 + 4\ CO_2 \uparrow + 4\ Co(OH)_3 \downarrow$$

The process as described is preferentially used for continuous production of refined nickel; however, a batch operation is also considered within the scope of this invention especially where high concentrations of cobalt are present, for example, 1 to 10 grams per liter.

Furthermore, by careful control of the oxidation potential and the pH of the electrolyte, it is possible to selectively precipitate unwanted elements and in this way a purer cobalt precipitate is obtained. This is advantageous to the process for recovery of this valuable metal.

The selective process involves two stages. In the first, the electrolyte is partially oxidized, adjusted to a pH slightly below that required for cobalt precipitation but high enough for precipitation of iron, arsenic and lead. After hydrolyzation, the iron, arsenic and lead precipitates are removed by filtration. In the second stage, the electrolyte is fully oxidized in an electrolytic tank and the pH in the retention tank is increased sufficiently to precipitate cobalt of high purity since the electrolyte is substantially free from iron, arsenic and lead at this point.

The use of other halide salts, e.g., bromides and iodides, of alkali metals is also contemplated in this invention and may be substituted for the sodium chloride addition. However, sodium chloride is preferred in the operation of this invention due to its ready availability and low cost.

In order to give those skilled in the art a better understanding of the invention, the following illustrative examples are given which demonstrate the capabilities of the process for substantial removal of cobalt, iron, arsenic and lead from a copper-free nickel-containing electrolyte.

EXAMPLE 1

Tank house electrolyte containing 73.0 grams per liter (typically 40–80 gpl nickel), about 33–45 gpl sodium, 46–56 gpl chloride, 100–150 gpl sulfate, 13–16 gpl boric acid and less than 0.01 gpl of dissolved copper and having a pH of 2.9 was passed through an electrolytic tank of 1 liter capacity. The tank contained a stainless steel wire cathode, 2.4 mm diameter by 6.4 cm long, and 2 graphite anodes 1.3 cm × 6.4 cm × 9 cm. A direct current of 4 amperes was supplied for the electrolysis at a current density of 8,400 amps./m$^2$ at the cathode, 410 amps./m$^2$ at the anode with a cell voltage of 5.5 volts. The power consumption was 3.3 watt-hours/liter and the average residence time for the electrolyte in the electrolytic tank was 9 minutes. The temperature of the electrolytic and retention tanks was controlled between 54°C. and 60°C. in this and all of the examples to be compatible with the currently used nickel electrorefining process.

Upon leaving the electrolytic tank, the oxidizing power of the solution was equivalent to 0.290 grams per liter of chlorine. Table I shows the level of cobalt, iron and arsenic as well as the pH of the feed to the electrolytic tank. The concentration of these elements in the effluent was only slightly lowered. A 30 minute hold in the agitated retention tank reduced the cobalt content of the electrolyte by 90.7%, the iron content by 97.8% and the arsenic content by 95.0%. This required the addition of 1.0 grams per liter of sodium carbonate to the retention tank. The nickel to cobalt ratio in the filtered precipitate was 3.0.

TABLE I

Electrolytic Oxidation of a Lead-Free Tank House Electrolyte

| | Co | Fe | As | pH |
|---|---|---|---|---|
| Electrolytic Tank Feed, gpl | 0.150 | 0.047 | 0.014 | 2.9 |
| Electrolytic Tank Effluent, gpl | 0.140 | 0.020 | 0.007 | 4.2 |
| Filtrate after 30 min. in Retention Tank, gpl | 0.014 | <0.001 | 0.0007 | 4.5 |

EXAMPLE 2

In a test similar to that described in Example 1, a tank house electrolyte essentially free of copper and arsenic and containing 69.1 gpl of nickel and having a pH of 2.8 was subjected to electrolytic oxidation. Current density was 8,400 amps./m$^2$ at the cathode, 410 amps./m$^2$ at the anode and the cell voltage was 5.5 volts. The solution had a residence time of 10 minutes in the electrolytic tank and the power consumption was 3.7 watt-hours per liter. The oxidizing power of the solution following this stage of the operation was equivalent to 0.457 gpl of chlorine. During the precipitation step, 1.5 gpl of sodium carbonate was added to the retention tank. As shown in Table II, after a 30-minute hold in the agitated retention tank and filtering, 97.7% of the cobalt, 99.2% of the iron and 93.6% of the lead were removed from the electrolyte. The ratio of nickel to cobalt in the precipitate was 1.2.

TABLE II

Electrolytic Oxidation of an Arsenic-Free Tank House Electrolyte

| | Co | Fe | Pb | pH |
|---|---|---|---|---|
| Electrolytic Tank Feed, gpl | 0.260 | 0.133 | 0.0047 | 2.8 |
| Electrolytic Tank Effluent, gpl | 0.250 | 0.030 | 0.001 | 3.7 |
| Filtrate after 30 minutes in Retention Tank, gpl | 0.006 | <0.001 | 0.0003 | 4.5 |

EXAMPLE 3

A synthetic electrolyte free from copper, lead and arsenic and containing 60.0 gpl of nickel and having a pH of 2.9 was subjected to electrolytic oxidation in the equipment described in Example 1. Current Density was 8,400 amps./m$^2$ at the cathode, 410 amps./m$^2$ at the anode and the cell voltage was 5.5 volts. The solution had a residence time of 6 minutes in the electrolytic tank and the power consumption was 2.2 watt-hours per liter. The oxidizing power of the solution following this stage of the operation was equivalent to 0.204 gpl of chlorine. A total of 0.92 gpl of sodium carbonate was added to the retention tank during the precipitation step. As shown in Table III, after a 30-minute hold in the agitated retention tank and filtering, the cobalt concentration was reduced by 98.7% and the iron by 97.5%. The ratio of nickel to cobalt in the filtered precipitation was 1.7.

TABLE III

Electrolytic Oxidation of an Arsenic- and Lead-Free Synthetic Electrolyte

| | Co | Fe | pH |
|---|---|---|---|
| Electrolytic Tank Feed, gpl | 0.150 | 0.040 | 2.9 |
| Electrolytic Tank Effluent, gpl | 0.145 | 0.025 | 4.1 |
| Filtrate after 30 minutes in Retention Tank, gpl | 0.002 | <0.001 | 4.5 |

EXAMPLE 4

A two-stage electrolytic oxidation treatment was carried out which selectively removed iron and arsenic while occluding only small amounts of nickel and cobalt in the first stage. Second stage electrolytic oxidation removed cobalt as a hydrate.

Tank house electrolyte with a pH of 2.9 was electrolytically oxidized for about 3 minutes to a state equivalent to 0.093 grams per liter of chlorine using the equipment described in Example 1. Current density was 8,400 amps./m$^2$ at the cathode, 410 amps./m$^2$ at the anode and the cell voltage was 5.5 volts. By adjusting the pH to 4.0 with 0.47 gpl of sodium carbonate in the agitated retention tank and holding for 1 hour at 54°C., 94.7% of the iron, 98.6% of the arsenic and 39.0% of the lead were removed. Table IV shows the assay of the electrolyte for this and the other stages of the process.

The solution was then brought to a state equivalent to 0.61 gpl of chlorine by electrolytically oxidizing for about 9 minutes using the aforedescribed current densities and voltage. By adjustment of the pH to 4.5, again through the addition of 1.0 gpl of sodium carbonate, and holding for one hour in the agitated retention tank, 98.5% of the cobalt was removed as a hydrate having a nickel to cobalt ratio of 1.4. An additional 4.8% of the iron was removed during this stage bringing the total for iron to 99.5% removed. Also, 56.8% more lead was removed at this point bringing the total percentage of lead removed to 95.8%. This selective removal process for iron, arsenic and lead followed by cobalt offers considerable advantage in later processing for recovery of cobalt from the precipitate.

TABLE IV

| Two-Stage Electrolytic Oxidation | Co | Fe | Pb | As |
|---|---|---|---|---|
| Starting Electrolyte, gpl | 0.26 | 0.133 | 0.0059 | 0.0045 |
| Filtrate 1, gpl | 0.26 | 0.007 | 0.0036 | 0.00006 |
| Filtrate 2, gpl | 0.004 | 0.0006 | 0.00025 | 0.00006 |

EXAMPLE 5

The minimum requirement for alkali metal ion was established by adding increasing amounts of sodium in the form of sodium sulfate to an electrolyte containing 0.068 gpl of sodium, 60.6 gpl of nickel, 36.6 gpl of chloride ion, 49.6 gpl of sulfate ion and 16 gpl of boric acid. The equipment used was the same as that previously described in Example 1. The cathode current density was 8,400 amps./m$^2$ and the pH of the solution was initially 3.1.

Table V shows that as the sodium ion concentration was increased, the final pH increased and, more importantly, that metallic nickel stopped forming upon the cathode when the pH in the electrolytic tank rises above the solution starting pH of 3.1.

TABLE V

| Alkali Metal Ion Concentration | | Cathode Deposit after 9 minutes at 4 amperes | |
|---|---|---|---|
| NA+ Concentration grams/liter | Final Tank pH | Weight Ni, mg | Composition |
| 0.0 | 2.05 | 550 | Metallic Ni |
| 0.5 | 2.40 | 470 | Metallic Ni + Trace of $Ni(OH)_2$ |
| 1.0 | 2.70 | 230 | Metallic Ni + $Ni(OH)_2$ |
| 1.5 | 3.10 | 160 | $Ni(OH)_2$ + Metallic Ni |
| 2.0 | 4.20 | 20 | $Ni(OH)_2$ + Trace Metallic Ni |
| 5.0 | 4.35 | 18 | $Ni(OH)_2$ only |
| 10.0 | 4.55 | 17 | $Ni(OH)_2$ only |
| 15.0 | 4.48 | 13 | $Ni(OH)_2$ only |
| 25.0 | 4.61 | 10 | $Ni(OH)_2$ only |
| 40.0 | 4.52 | 10 | $Ni(OH)_2$ only |

EXAMPLE 6

Controlling the pH of the electrolyte entering the electrolytic tank is important to the efficiency with which impurities can be removed. A tank-house electrolyte containing 69.0 gpl of nickel, 0.260 gpl of cobalt, 0.006 gpl of lead, 0.0045 gpl arsenic and 0.133 gpl of iron was introduced to an electrolytic tank as described in Example 1. Upon entering this tank, the pH was continuously adjusted by addition of sodium carbonate solution from a first addition tank so that constant values ranging from pH 2.7 to 5.2 were attained. The cathode current density was generally about 16,800 amps./m$^2$ and the oxidizing power of the electrolyte was equivalent to about 0.85 gpl of chlorine. As shown in Table VI, the efficiency of cobalt removal was increased from 88.5% to 98.8% while the efficiency of lead, arsenic and iron removal remained constant. This improvement however, is offset by an increase in the quantity of nickel co-precipitated with the cobalt.

TABLE VI

| Effect of Electrolyte pH on Impurity Removal | 1 | 2 | 3 | 4 | 5 |
|---|---|---|---|---|---|
| Electrolyte Feed pH | 2.7 | 3.2 | 3.7 | 4.7 | 5.2 |
| Electrolyte Effluent pH | 3.8 | 3.9 | 4.1 | 4.2 | 4.2 |
| Cathode Current Density amps./m$^2$ | 16,800 | 12,600 | 16,800 | 16,800 | 16,800 |
| Electrolytic Tank Voltage | 9.0 | 7.0 | 9.0 | 9.0 | 9.0 |
| Chlorine Generation gpl | 0.87 | 0.85 | 0.82 | 0.80 | 0.90 |
| Final Cobalt Content gpl | 0.030 | 0.012 | 0.016 | 0.012 | 0.003 |
| Removal Efficiency, % | | | | | |
| Co | 88.5 | 95.4 | 93.8 | 95.4 | 98.8 |
| Pb | 98.3 | 98.3 | 98.3 | 98.3 | 98.3 |
| Fe | 98.5 | 98.5 | 98.5 | 98.5 | 99.6 |
| As | 98.6 | 98.6 | 98.6 | 98.6 | 98.6 |
| Ratio Ni:Co in Precipitate | 1.9 | 2.7 | 3.1 | 3.5 | 4.0 |

EXAMPLE 7

Utilization of the metal hydroxide generated in the electrolytic oxidation process is an important feature since it reduces the amount of alkali required for precipitation of impurities. The results contained in Table VII show the amount of alkali required to precipitate the impurities with and without the use of electrolytic oxidation for the purification of the tank house electrolyte described previously in Example 2.

TABLE VII

Materials and Power Consumed During Electrolytic Oxidation

| | cobalt removal gpl | $Na_2CO_3$ equivalent gpl | chlorine gpl | power watt-hours/liter |
|---|---|---|---|---|
| Without electrolytic oxidation | 0.244 | 2.74 | 0.085 | nil |
| With electrolytic oxidation | 0.254 | 1.50 | nil | 3.7 |

The soda ash equivalent is 1.24 grams/liter less for the electrolytic oxidation process than for the presently used process. The consumption of 45% less alkali coupled with in situ generation of chlorine represents a considerable savings in raw materials and indirectly, in power requirements.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for removing at least one impurity from a group consisting of cobalt, iron, arsenic and lead from an aqueous, essentially copper-free, nickel-containing electrolyte which comprises: immersing at least one anode and at least one cathode into said electrolyte, said electrolyte containing a chloride salt of an alkali metal; applying current between said anode and said cathode for a time period sufficient to generate in said electrolyte an equivalent chlorine content of at least about 0.05 gram per liter while maintaining the current density at said cathode at a level sufficient to prevent substantial deposition of metal at said cathode but sufficient to generate a metal hydroxide in the vicinity of said cathode; increasing the pH of said electrolyte whereby said equivalent chlorine produced reacts with at least one impurity present in said electrolyte to provide a precipitate containing said at least one impurity; and separating said precipitate from said electrolyte.

2. A process as defined in claim 1, wherein the total surface area of said anode is at least 20 times the surface area of said cathode.

3. A process as defined in claim 1, wherein a current density of 6,000 to 39,000 amperes per square meter is maintained on the surface of said cathode.

4. A process as defined in claim 1, wherein said chloride salt of an alkali metal is sodium chloride.

5. A process as defined in claim 4, wherein the concentration of sodium ions is at least about 2 grams per liter and the concentration of chloride ions is at least about 5 grams per liter.

6. A process as defined in claim 1, wherein the pH of said electrolyte is about 2.5 to 5.5, and following electrolysis said electrolyte has a pH of about 3.8 to 4.2; and the pH is thereafter adjusted into the range of about 4.5 to 5.0 to provide a precipitate of at least one metal from the group consisting of cobalt, iron, arsenic and lead.

7. A process as defined in claim 1, wherein said electrolyte is oxidized to a concentration equivalent to 0.05 to 1.0 grams per liter of chlorine.

8. A process as defined in claim 1, wherein said electrolyte is subject to said current for about 2 minutes to about 20 minutes.

9. A process as defined in claim 1, wherein said equivalent chlorine is reacted with said impurity for a time period of about 20 minutes to about 2 hours.

10. A process as defined in claim 1, wherein said anode is an insoluble material resistant to corrosion in acid solution.

11. A process as defined in claim 1, wherein said cathode is a steel.

12. A process as defined in claim 1, wherein said electrolyte is agitated to prevent said metal hydroxide from settling.

13. A process for removing at least one impurity from a group consisting of cobalt, iron, arsenic and lead from an aqueous, essentially copper-free, nickel-containing electrolyte which comprises: immersing at least one anode and at least one cathode into said electrolyte, said electrolyte containing a chloride salt of an alkali metal; applying current between said anode and said cathode for a time period sufficient to generate in said electrolyte an equivalent chlorine content of at least about 0.05 and up to about 0.2 gram per liter while maintaining a current density at said cathode at a level sufficient to prevent substantial deposition of metal at said cathode but sufficient to generate a metal hydroxide in the vicinity of said cathode; increasing the pH of said electrolyte into a range of about 3.8 to 4.2 whereby said equivalent chlorine produced reacts with at least one impurity from a group consisting of iron, arsenic and lead present in said electrolyte to provide a precipitate containing said at least one impurity; separating said precipitate from said electrolyte; reapplying current between said anode and said cathode for a time period sufficient to generate in said electrolyte an equivalent chlorine content of at least about 0.4 gram per liter while maintaining a current density at said cathode at a level sufficient to prevent substantial deposition of metal at said cathode but sufficient to generate a metal hydroxide in the vicinity of said cathode; increasing the pH of said electrolyte into a range of about 4.5 to 5.0 whereby said equivalent chlorine produced reacts with at least one impurity from a group consisting of cobalt, iron, arsenic and lead present in said electrolyte to provide a precipitate containing said at least one impurity; and separating said precipitate from said electrolyte.

14. A process as defined in claim 13, wherein said chloride salt of an alkali metal is sodium chloride.

* * * * *

UNITED STATES PATENT OFFICE

CERTIFICATE OF CORRECTION

PATENT NO. : 3,983,018

DATED : September 28, 1976

INVENTOR(S) : GYULA JOHN BORBELY, ALEXANDER ILLIS, & BERNARDUS JACOBUS BRANDT

It is certified that error appears in the above-identified patent and that said Letters Patent are hereby corrected as shown below:

In column 9, in Table VII, under the heading "chlorine", the number "0.085" should be "0.85".

gpl

Signed and Sealed this

Twenty-second Day of February 1977

[SEAL]

*Attest:*

RUTH C. MASON
*Attesting Officer*

C. MARSHALL DANN
*Commissioner of Patents and Trademarks*